US008641244B2

(12) United States Patent
Kwon et al.

(10) Patent No.: US 8,641,244 B2
(45) Date of Patent: Feb. 4, 2014

(54) LIGHTING APPARATUS

(75) Inventors: Seong Hun Kwon, Changwon-si (KR); Sang Cheon Kim, Changwon-si (KR); Moon Goo Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 517 days.

(21) Appl. No.: 12/971,493

(22) Filed: Dec. 17, 2010

(65) Prior Publication Data

US 2011/0148321 A1 Jun. 23, 2011

(30) Foreign Application Priority Data

Dec. 18, 2009 (KR) ..... 10-2009-0127360

(51) Int. Cl.
*H05B 37/02* (2006.01)

(52) U.S. Cl.
USPC ..... 362/373; 362/294

(58) Field of Classification Search
USPC ..... 165/120; 362/294, 373
See application file for complete search history.

(56) References Cited

U.S. PATENT DOCUMENTS

2010/0177519 A1* 7/2010 Schlitz ..... 362/294
2011/0139408 A1* 6/2011 Jewell-Larsen et al. ..... 165/120

FOREIGN PATENT DOCUMENTS

JP 2008-078260 A 4/2008
JP 2008-306084 A 12/2008
KR 10-2006-0027039 A 3/2006
KR 10-2006-0120904 A 11/2006

OTHER PUBLICATIONS

Korean Notice of Allowance dated Nov. 29, 2013 for corresponding Application No. 10-2009-0127360.

* cited by examiner

*Primary Examiner* — Anabel Ton
(74) *Attorney, Agent, or Firm* — KED & Associates LLP

(57) ABSTRACT

A lighting apparatus is disclosed. The lighting apparatus is configured such that a light-emitting unit is cooled through movement of air ionized by corona discharge, rather than using a fan that generates noise, resulting in reduced operational noise.

16 Claims, 10 Drawing Sheets

LIGHTING APPARATUS

This application claims the benefit of Korean Patent Application No. 10-2009-0127360, filed on Dec. 18, 2009, which is hereby incorporated by reference as if fully set forth herein.

BACKGROUND OF THE INVENTION

1. Field of the Invention

The present invention relates to a lighting apparatus, and more particularly, to a lighting apparatus in which a light-emitting unit can emit light through corona discharge.

2. Discussion of the Related Art

Lighting has played a key role in advance in human culture and has been closely connected to the advancement of the human race since the dawn of time.

Recently, advances in the lighting industry have progressed at a vigorous pace and numerous studies related to light sources, light emitting methods, driving methods and efficiency enhancement have been conducted.

Examples of current light sources used in lighting apparatuses include incandescent bulbs, fluorescent lamps and discharge lamps. These light sources have been used for a variety of purposes, such as domestic, industrial, and outdoor purposes.

However, light sources operating based upon electrical resistance, such as incandescent bulbs, etc., have problems of low efficiency and high heat loss, discharge lamps are expensive and exhibit poor energy efficiency, and fluorescent lamps have a problem of environment pollution due to use of mercury.

To solve disadvantages of these light sources, interest in light emitting diodes, which have a great number of advantages, such as high efficiency and realization of various colors and designs, etc., is increasing.

In particular, demand for a surface light source having more uniform optical characteristics than point/linear light sources is increasing.

SUMMARY OF THE INVENTION

Accordingly, the present invention is directed to a lighting apparatus that substantially obviates one or more problems due to limitations and disadvantages of the related art.

An object of the present invention is to provide a lighting apparatus capable of reducing operational noise caused by cooling of a light-emitting unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a housing having an air suction hole and an air discharge hole, a light-emitting unit including a substrate placed in the housing and at least one Light Emitting Diode (LED) mounted on the substrate, and a corona electrode and a collector electrode to discharge heat radiated from the light-emitting unit to the outside through the air discharge hole via corona discharge.

In accordance with another aspect of the present invention, a lighting apparatus includes a housing having an air suction hole and an air discharge hole, a light-emitting unit including a substrate placed in the housing and at least one Light Emitting Diode (LED) mounted on the substrate, a heat sink mounted to the substrate and serving to dissipate heat radiated from the LED, a collector electrode placed below the heat sink, and a corona electrode spaced below the collector electrode by a predetermined distance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
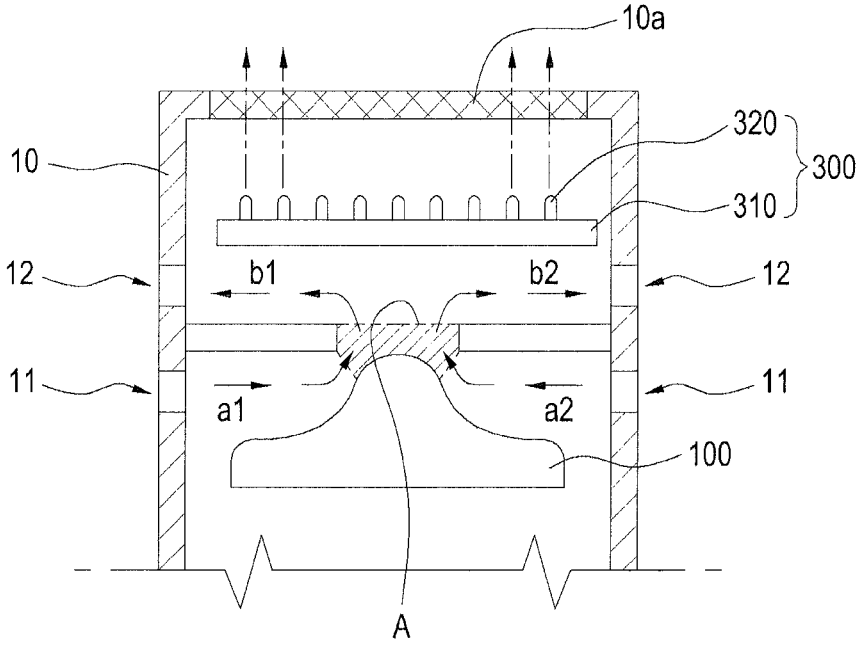
FIG. 1 is a sectional view illustrating a schematic configuration of a lighting apparatus according to an embodiment of the present invention.

Reference will now be made in detail to the preferred embodiments of the present invention, examples of which are illustrated in the accompanying drawings. The accompanying drawings illustrate exemplary embodiments of the present invention and provide a more detailed description of the present invention. However, the scope of the present invention should not be limited thereto.

In addition, wherever possible, the same reference numbers will be used throughout the drawings to refer to the same or like parts, and a repeated description thereof will be omitted. For clarity, dimensions and shapes of respective constituent members illustrated in the drawings may be exaggerated or reduced.

In the meantime, although terms including an ordinal number, such as first or second, may be used to describe a variety of constituent elements, the constituent elements are not limited to the terms, and the terms are used only for the purpose of discriminating one constituent element from other constituent elements.

FIG. 1 is a sectional view illustrating a schematic configuration of a lighting apparatus according to an embodiment of the present invention.

Referring to FIG. 1, the lighting apparatus according to the embodiment of the present invention includes a housing 10 having an air suction hole 11 and an air discharge hole 12, a light-emitting unit 300, and a corona electrode 100 and a collector electrode 200 which serve to discharge heat radiated from the light-emitting unit 300 to the outside through the air discharge hole 12 via corona discharge. The light-emitting unit 300 includes a substrate 310 placed in the housing 10 and at least one Light Emitting Diode (LED) 320 mounted on the substrate 310.

The housing 10 may have a light emitting surface 10*a* to transfer light, emitted from the LED 320, to the outside. Herein, for convenience of description, a direction facing the light emitting surface is referred to as an upper portion of a specific constituent member and an opposite direction is referred to as a lower portion of the specific constituent member.

Here, the corona electrode 100 may include a raised electrode region 110, and a through-hole 210 may be formed through the collector electrode 200. The raised electrode region 110 of the corona electrode 100 may be located inside the through-hole 210 of the collector electrode 200.

In this case, air ionized by corona discharge may be directed from a space A between the raised electrode region 110 of the corona electrode 100 and the collector electrode 210 into the through-hole 210 of the collector electrode 200.

The through-hole 210 of the collector electrode 200 may have a smaller cross section than a cross section of the raised electrode region 110 of the corona electrode 100.

Accordingly, the ionized air, introduced into the space A between the raised electrode region 110 of the corona electrode 100 and the collector electrode 200, is accelerated while passing through the through-hole 210 of the collector electrode 200. This nozzle shaped flow path may increase cooling efficiency of the light-emitting unit 300.

The lighting apparatus according to the embodiment of the present invention may further include a controller which generates a control signal required to apply voltage to the corona electrode 100 and the collector electrode 200, and a voltage supply unit which applies voltage to the corona electrode 100 and the collector electrode 200 in response to the control signal.

More specifically, if voltage is applied to the corona electrode 100 and the collector electrode 200, the air present between the corona electrode 100 and the collector electrode 200 is ionized, in turn causing the ionized air to move from the corona electrode 100 to the collector electrode 200.

Here, the corona electrode 200 is provided with the raised electrode region 110 and an electric field is created between the raised electrode region 110 and the collector electrode 200 to facilitate ionization of air. The ionized air is moved from the corona electrode 100 to the collector electrode 200.

In this way, in the lighting apparatus according to the embodiment of the present invention, forced movement of the ionized air between the corona electrode 100 and the collector electrode 200 occurs, and in turn, the forced movement of the ionized air may result in dissipation of heat from the light-emitting unit 300.

Although FIG. 1 illustrates the raised electrode region 110 of the corona electrode 100 as having a gentle curved shape, the present invention is not limited thereto, and the raised electrode region 110 of the corona electrode 100 may take the form of a probe.

Referring to FIG. 1, in the case of the lighting apparatus in which the collector electrode 200 is provided with the through-hole 210 and the raised electrode region 110 of the corona electrode 100 is located inside the through-hole 210, the forced movement of the ionized air occurs between the raised electrode region 110 of the corona electrode 100 and the collector electrode 200.

In this case, the corona electrode 100 and the collector electrode 200 may be spaced apart from each other, and also, the collector electrode 200 and the light-emitting unit 300 may be spaced apart from each other.

More specifically, the substrate 310 of the light-emitting unit 300 may be located above the collector electrode 200, and the corona electrode 100 may be located below the collector electrode 200. Also, a first air channel may be defined between the corona electrode 100 and the collector electrode 200, and a second air channel may be defined between the collector electrode 200 and the light-emitting unit 300.

Here, if air is suctioned through the air suction hole 11 of the housing 10, the air is introduced into the space A between the corona electrode 100 and the collector electrode 200 along the first air channel (designated by arrows 'a1' and 'a2' of FIG. 1).

The air is ionized in the space A between the raised electrode region 110 of the corona electrode 100 and the collector electrode 200, and is moved from the corona electrode 100 to the through-hole 210 of the collector electrode 200. The ionized air is discharged through the second air channel (designated by arrows 'b1' and 'b2' of FIG. 1).

Accordingly, the light-emitting unit 300 comes into contact with and is cooled by the air discharged into the second air channel.

As described above, the lighting apparatus according to the embodiment of the present invention is configured such that the light-emitting unit 300 is cooled via movement of air ionized by corona discharge, rather than installing a fan that tends to generate noise, thereby achieving noise reduction.

Further, the lighting apparatus according to the embodiment of the present invention may be configured such that the light-emitting unit 300 may be cooled via movement of air induced through ElectroHydroDynamics (EHD), thereby achieving enhanced cooling efficiency.

Figure 2:
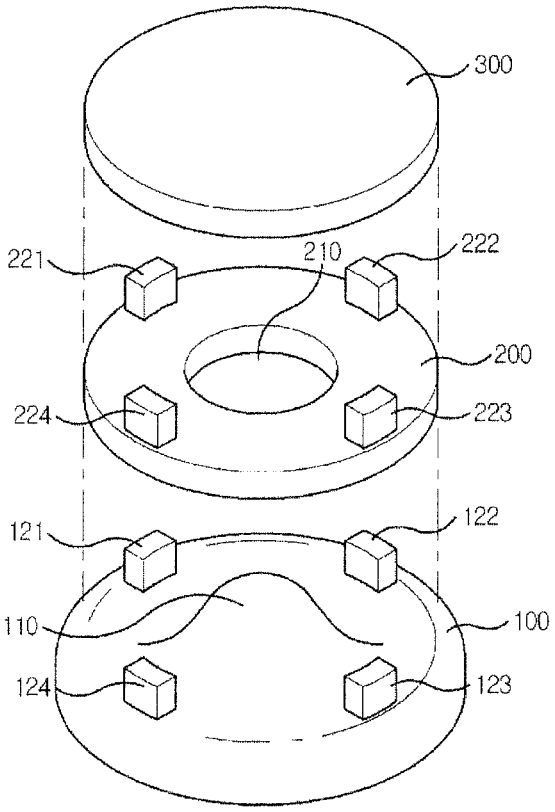
FIG. 2 is a schematic exploded perspective view of a lighting apparatus according to a first embodiment of the present invention.

FIG. 2 is a schematic exploded perspective view of a lighting apparatus according to a first embodiment of the present invention.

To ensure that the corona electrode 100, the collector electrode 200 and the light-emitting unit 300 are spaced apart from one another by the necessary predetermined distances as described above, the lighting apparatus according to the first embodiment of the present invention may further include a supporting member provided in at least one of a space between the corona electrode 100 and the collector electrode 200 and a space between the collector electrode 200 and the light-emitting unit 300.

Here, the supporting member may be provided with a flow path to allow any one of the aforementioned spaces to be communicated with the air suction hole 11 or the air discharge hole 12 of the housing 10.

The supporting member may have various configurations and shapes suitable to serve as both a spacer and a flow path. In an alternative embodiment, the supporting member may include a plurality of supporting pieces 121 to 124 and 221 to 224 which are arranged with predetermined distances therebetween in a peripheral direction of any one electrode.

Here, a space between the two neighboring supporting pieces may serve as a flow path.

Referring to FIG. 2, a plurality of first supporting pieces 121, 122, 123 and 124 may be arranged on one surface of the corona electrode 100 where the raised electrode region 110 is present.

When the collector electrode 200 is located above the plurality of first supporting pieces 121, 122, 123 and 124, the corona electrode 100 and the collector electrode 200 are spaced apart from each other by a predetermined distance so as not to come into contact with each other.

In addition, a plurality of second supporting pieces 221, 222, 223 and 224 may be arranged on an upper surface of the collector electrode 200.

When the light-emitting unit 300 is located above the second supporting pieces 221, 222, 223 and 224, the collector electrode 200 and the light-emitting unit 300 are spaced apart from each other.

Spaces between the respective neighboring first supporting pieces 121, 122, 123 and 124 may define the first air channel into which air is introduced, and spaces between the respective neighboring second supporting pieces 221, 222, 223 and 224 may define the second air channel from which air is discharged.

Figure 3:
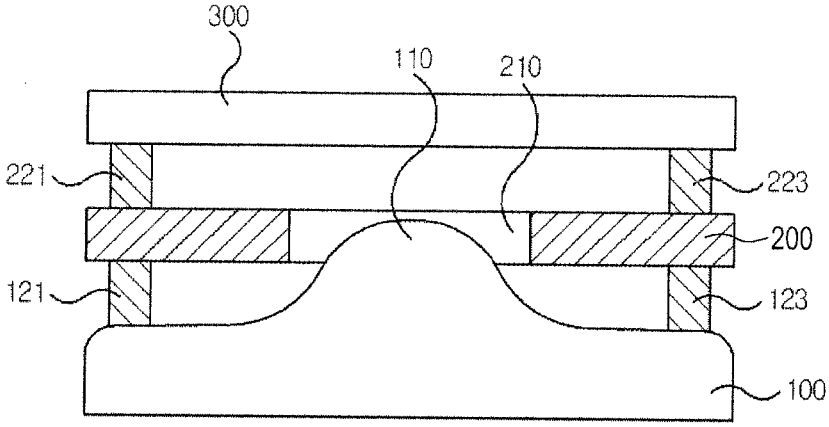
FIG. 3 is a schematic sectional view of the lighting apparatus according to the first embodiment of the present invention.

Referring to FIGS. 2 and 3, the collector electrode 200 is located above the plurality of first supporting pieces 121, 122, 123 and 124 provided at the corona electrode 100, and a predetermined space is defined between the corona electrode 100 and the collector electrode 200.

The light-emitting unit 300 is located above the plurality of second supporting pieces 221, 222, 223 and 224 arranged on the upper surface of the collector electrode 200, and a predetermined space is defined between the collector electrode 200 and the light-emitting unit 300.

The first and second supporting pieces 121, 122, 123, 124, 221, 222, 223 and 224 may be made of non-conductive materials.

Figure 4:
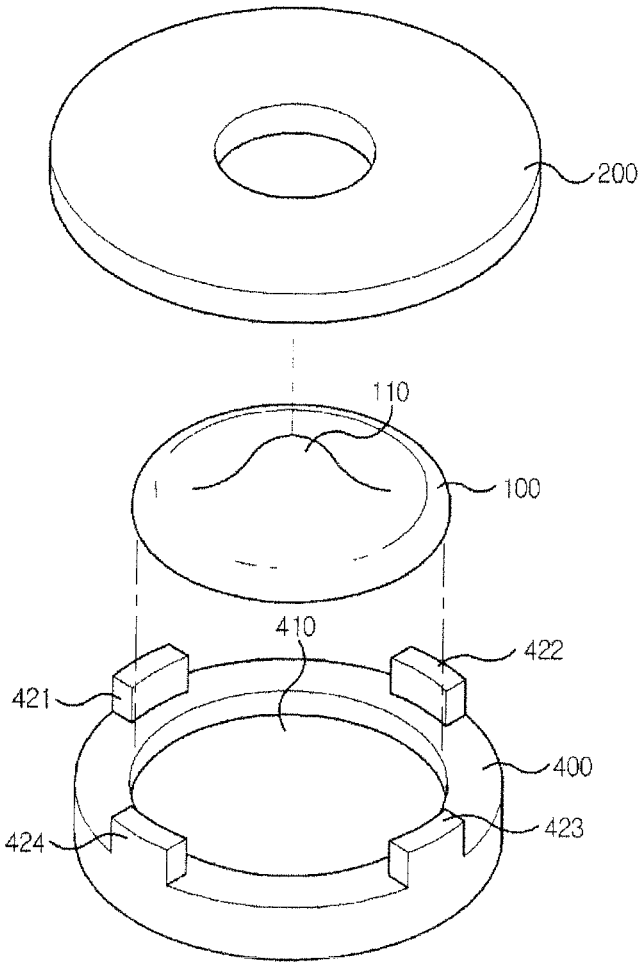
FIG. 4 is a schematic partially exploded perspective view illustrating a lighting apparatus according to a second embodiment of the present invention.

FIG. 4 is a schematic partially exploded perspective view illustrating a lighting apparatus according to a second embodiment of the present invention.

The lighting apparatus according to the second embodiment of the present invention may further include a receiving member 400 (in the form of a jig) fixed in the housing 10 such that the corona electrode 100 is seated therein. The receiving member 400 may have a recess 410 or through-hole for insertion of the corona electrode 100.

Figure 5:
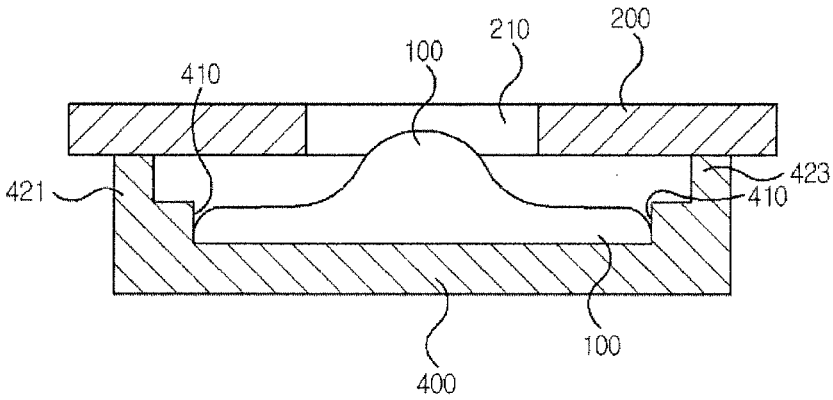
FIG. 5 is a schematic partially sectional view of the lighting apparatus according to the second embodiment of the present invention.

Referring to FIG. 5, the corona electrode 100 may be seated in the recess 410 of the receiving member 400, assuring stable positioning thereof.

The receiving member 400 may be provided at an upper surface thereof with supporting pieces 421, 422, 423 and 424 spaced apart from one another.

In addition, referring to FIG. 5, the cross section of the corona electrode 100 may be smaller than the cross section of the collector electrode 200.

More specifically, since the corona electrode 100 has a smaller diameter than a diameter of the collector electrode 200, an electric field created between the collector electrode 200 and the corona electrode 100 may be concentrated on the smaller area of the corona electrode 100 facing the collector electrode 200.

Figure 6:
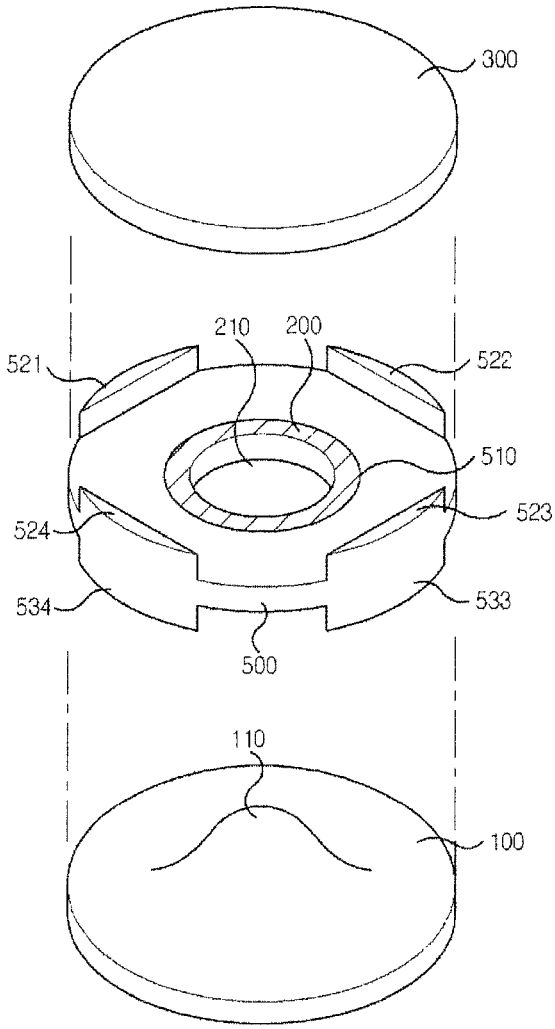
FIG. 6 is a schematic exploded perspective view illustrating a lighting apparatus according to a third embodiment of the present invention.

FIG. 6 is a schematic exploded perspective view illustrating a lighting apparatus according to a third embodiment of the present invention.

The lighting apparatus according to the third embodiment may further include a receiving member 500 having a through-hole 510 into which the collector electrode 200 is inserted and fixed.

The collector electrode 200 may be inserted into and fixed in the through-hole 510 of the receiving member 500.

The receiving member 500 may be provided at an upper surface thereof with supporting pieces 521, 522, 523 and 524 spaced apart from one another, and may also be provided at a lower surface thereof with supporting pieces 531, 532, 533 and 534 spaced apart from one another.

Figure 7:
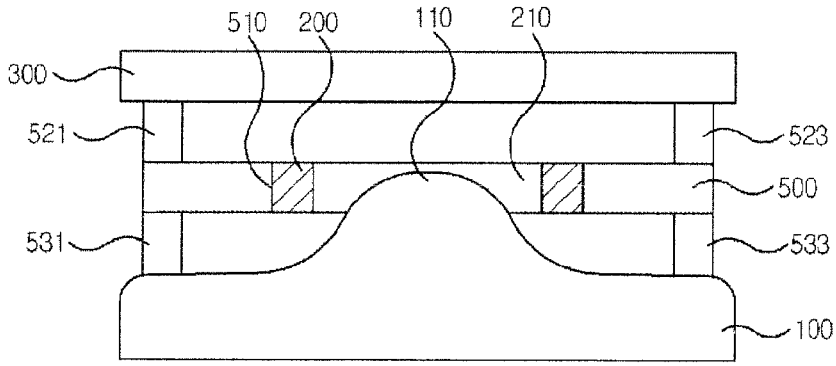
FIG. 7 is a schematic sectional view of the lighting apparatus according to the third embodiment of the present invention.

Referring to FIG. 7, after the collector electrode 200 is inserted into the through-hole 510 of the receiving member 500, the receiving member 500 may be placed on the corona electrode 100.

In addition, the light-emitting unit 300 may be placed on the receiving member 500.

In this case, as the supporting pieces 531, 532, 533 and 534 are provided on the lower surface of the receiving member 500, the corona electrode 100 and the collector electrode 200 may be spaced apart from each other by a predetermined distance.

Also, as the supporting pieces 521, 522, 523 and 524 are provided on the upper surface of the receiving member 500, the collector electrode 200 and the light-emitting unit 300 may be spaced apart from each other by a predetermined distance.

Figure 8:
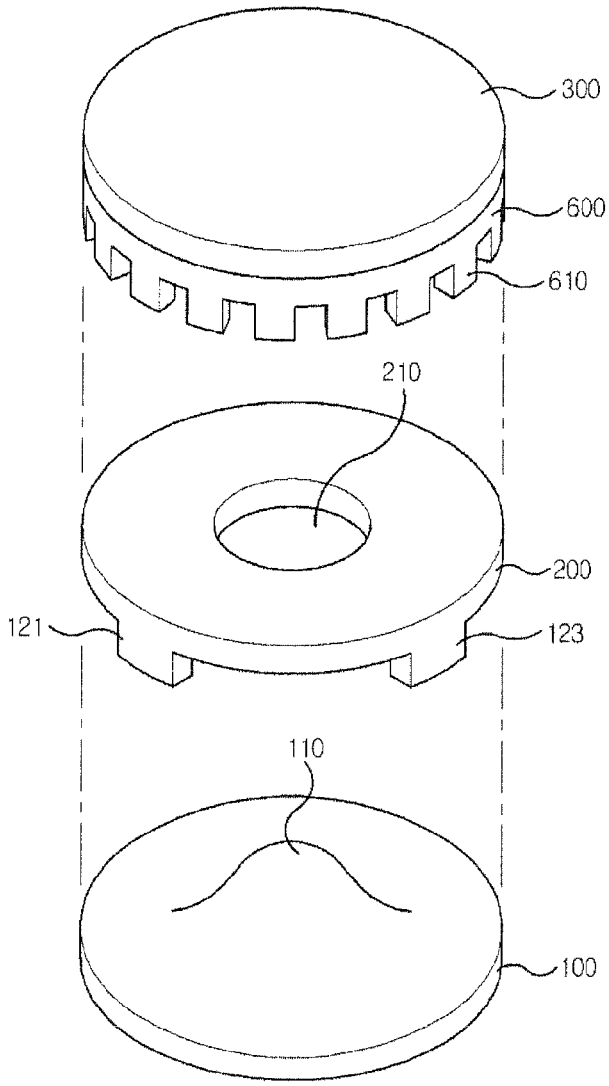
FIG. 8 is a schematic exploded perspective view illustrating a lighting apparatus according to a fourth embodiment of the present invention.

FIG. 8 is a schematic exploded perspective view of a lighting apparatus according to a fourth embodiment of the present invention.

In addition to the housing 10 having the air suction hole 11 and the air discharge hole 12, the light-emitting unit 300 including the substrate 310 placed in the housing 10 and the at least one LED 320 mounted on the substrate 310 (see FIG. 1), the lighting apparatus according to the present embodiment includes a heat sink 600 mounted on the substrate 310 to conduct heat radiated from the LED 320, the collector electrode 200 placed below the heat sink 600, and the corona electrode 100 spaced below the collector electrode 200 by a predetermined distance.

The heat sink 600 may include a plurality of fins 610.

In this case, the fins 610 of the heat sink 600 may come into contact with the collector electrode 200, and may be made of an insulating material.

However, if the fins 610 of the heat sink 600 are made of a conductive material, an insulator may be provided between the fins 610 and the collector electrode 200.

As described above, the corona electrode 100 is provided with the raised electrode region 110 and the collector electrode 200 is provided with the through-hole 210, such that the raised electrode region 110 of the corona electrode 100 may be located inside the through-hole 210.

Here, air ionized by corona discharge may be directed from the space between the raised electrode region 110 of the corona electrode 100 and the collector electrode 200 into the through-hole 210 of the collector electrode 200, thereby being discharged to the outside through a space between the two neighboring fins 610.

Figure 9:
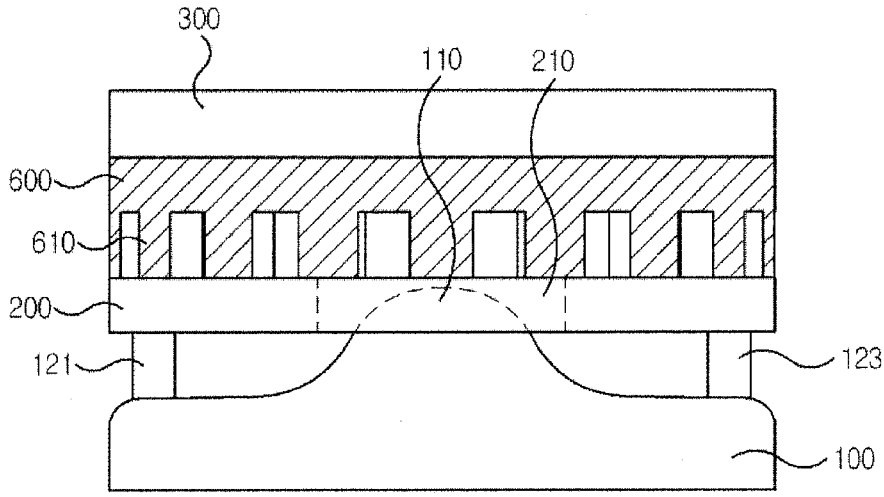
FIG. 9 is a schematic sectional view of the lighting apparatus according to the fourth embodiment of the present invention.

Specifically, referring to FIG. 9, the space between the neighboring fins 610 of the heat sink 600 may serve as a channel enabling movement of air.

Accordingly, the lighting apparatus having the above-described configuration has no need for the above-described supporting pieces between the heat sink 600 and the collector electrode 200 because the fins 610 of the heat sink 600 function as supporting pieces between the heat sink 600 and the collector electrode 200.

The collector electrode 200 may be provided at a lower surface thereof with insulating supporting pieces 121 and 123.

Figure 10:
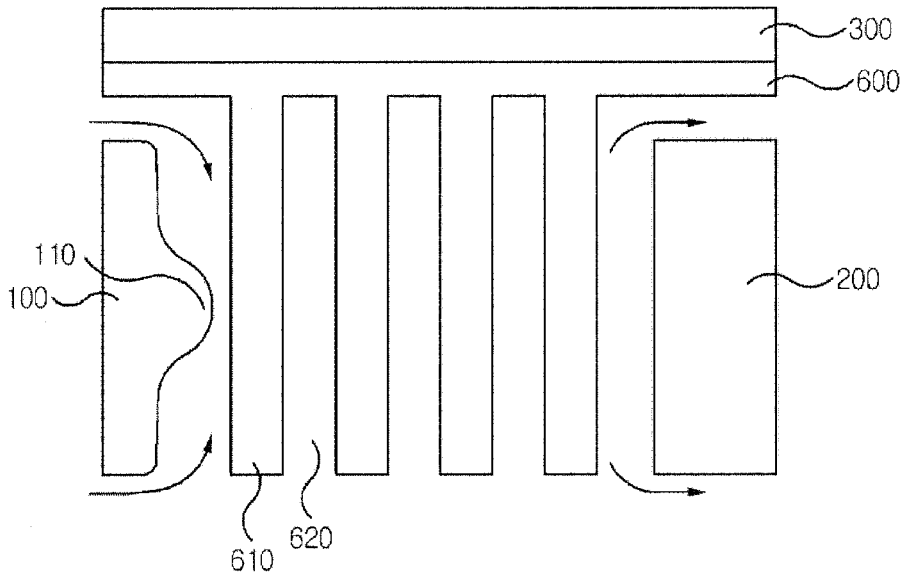
FIG. 10 is a schematic sectional view of a lighting apparatus according to a fifth embodiment of the present invention.

FIG. 10 is a schematic sectional view of a lighting apparatus according to a fifth embodiment of the present invention.

The lighting apparatus according to the fifth embodiment of the present invention may be configured such that the fins 610 of the heat sink 600 extend into a space between the collector electrode 200 and the corona electrode 100.

Referring to FIG. 10, the heat sink 600 having the fins 610 may be attached to a lower surface of the substrate of the light-emitting unit 300. The corona electrode 100 may be located at the left side of the fins 610, and the collector electrode 200 may be located at the right side of the fins 610.

In this case, the neighboring fins 610 of the heat sink 600, the corona electrode 100 and the collector electrode 200 may be spaced apart from each other by predetermined distances, allowing air to pass through spaces therebetween.

Specifically, air is introduced into a space between the heat sink 600 and the corona electrode 100 and is discharged from a space between the heat sink 600 and the collector electrode 200.

Figure 11:
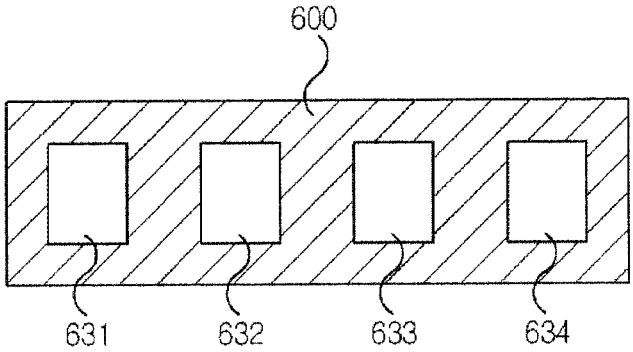
FIG. 11 is a view illustrating a configuration of a heat sink provided in the lighting apparatus according to the fifth embodiment of the present invention.

Referring to FIG. 11, the heat sink 600 may be provided with a plurality of channels 631, 632, 633 and 634 for movement of air. The heat sink 600 having the above-described configuration does not require the above-described fins 610.

Figure 12:
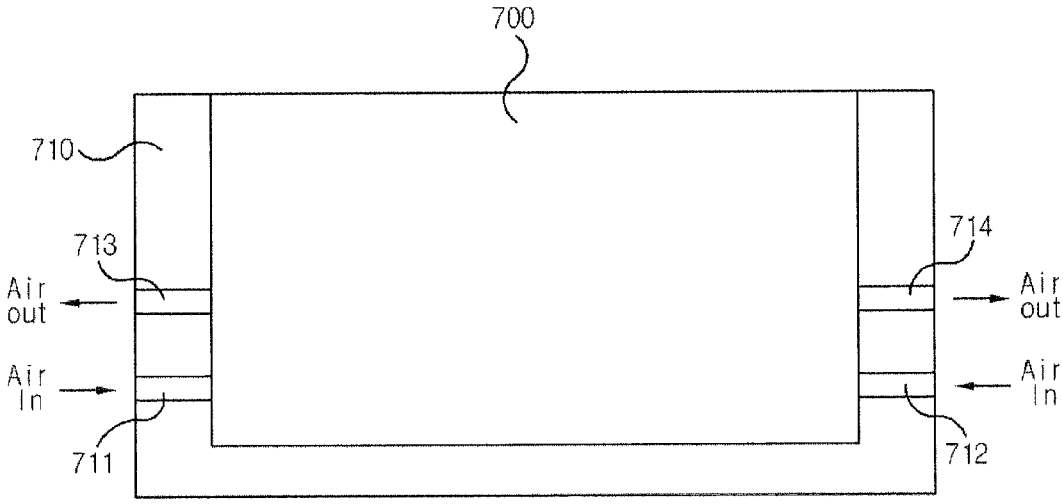
FIG. 12 is a schematic sectional view illustrating a housing constituting a lighting apparatus according to the present invention.

FIG. 12 is a schematic sectional view illustrating a housing constituting a lighting apparatus according to the present invention.

The lighting apparatus according to the present invention may include a housing 710 having various configurations and shapes.

The housing 710 defines the external appearance of the lighting apparatus. The housing 710 may include an inner region 700 in which constituent members of the lighting apparatus may be received, air suction holes 711 and 712 and air discharge holes 713 and 714.

The positions and sizes of the holes 711, 712, 713 and 714 provided in the housing 710 may be variously determined according to desired external appearance, cooling capacity and the like.

In an alternative embodiment, the air suction holes 711 and 712 may be located in a lower portion of the housing 710, and the air discharge holes 713 and 714 may be located in an upper portion of the housing 710.

Figure 13:
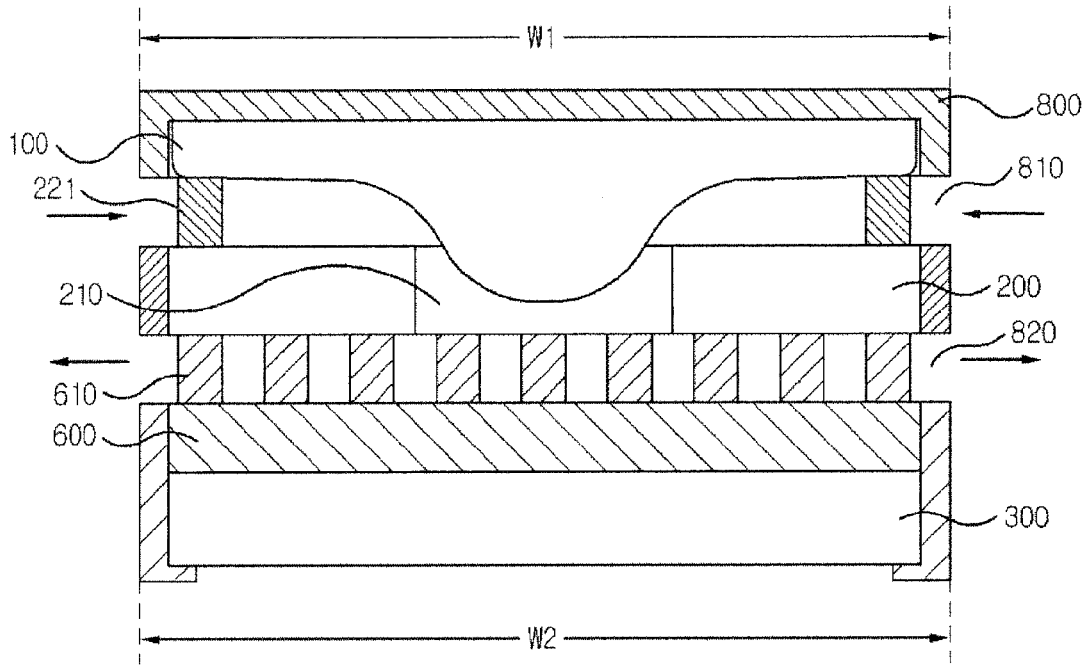
FIG. 13 is a schematic sectional view illustrating one example of a lighting apparatus according to the present invention.
Figure 14:
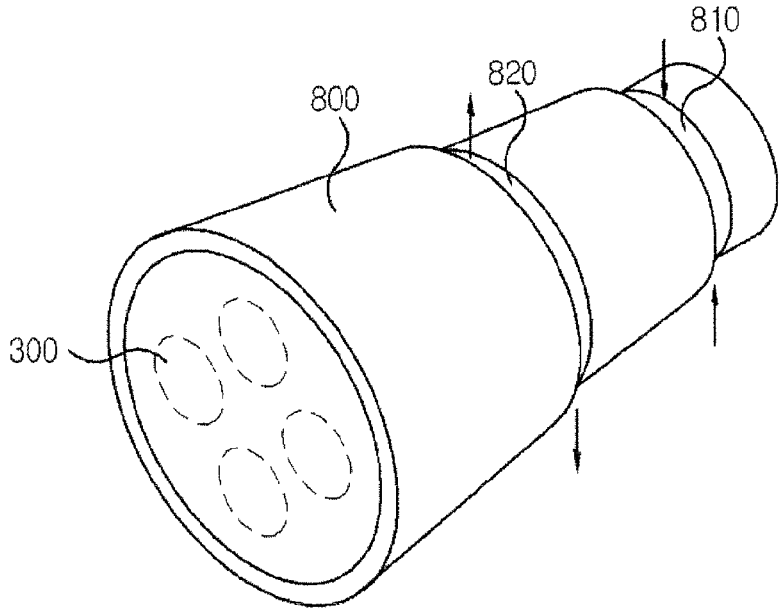
FIG. 14 is a schematic perspective view of the lighting apparatus illustrated in FIG. 13.

FIG. 13 is a schematic sectional view illustrating one example of a lighting apparatus according to the present invention.

The lighting apparatus according to the present embodiment may include the corona electrode 100, the collector electrode 200 spaced apart from the corona electrode 100, the supporting member 221 interposed between the corona electrode 100 and the collector electrode 200, the heat sink 600 having the plurality of fins 610 coming into contact with the collector electrode 200, the light-emitting unit 300 coming into contact with the heat sink 600, and a housing 800 surrounding the aforementioned respective constituent elements.

Here, the first air channel may be defined between the corona electrode 100 and the collector electrode 200, and the second air channel may be defined between the collector electrode 200 and the light-emitting unit 300.

The housing 800 may be provided with air suction holes 810 and air discharge holes 820.

The first air channel may be connected to the air suction holes 810, and the second air channel may be connected to the air discharge holes 820.

In the lighting apparatus, a width W1 of a region where the corona electrode 100 is present and a width W2 of a region where the light-emitting unit 300 is present may be freely adjusted in consideration of desired external appearance, cooling capacity and the like.

Figure 15:
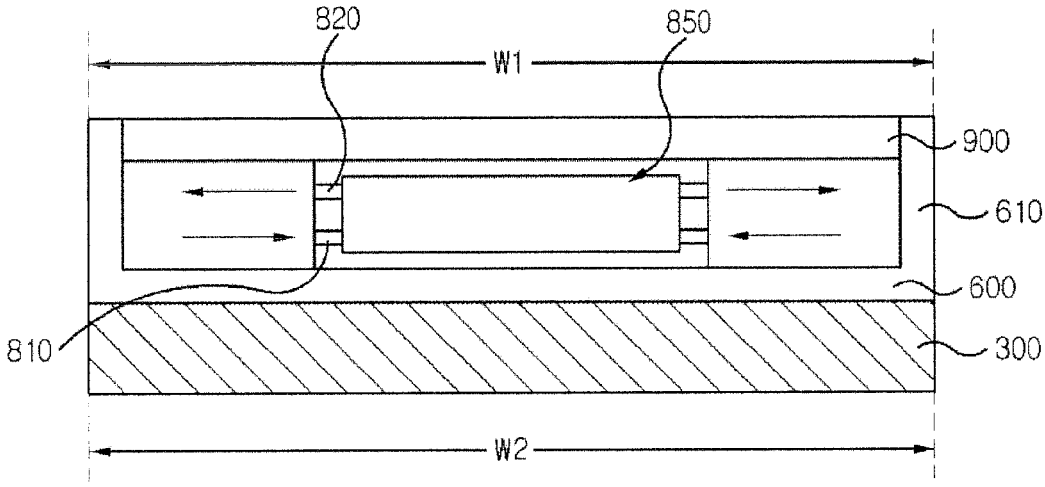
FIG. 15 is a schematic sectional view illustrating another example of a lighting apparatus according to the present invention.

FIG. 15 is a schematic sectional view illustrating another example of a lighting apparatus according to the present invention.

The lighting apparatus according to the present embodiment may include the heat sink 600 having the plurality of fins 610 arranged on an outer edge thereof, the lighting-emitting unit 300 coming into contact with the heat sink 600, and a radiator 850 located inside the plurality of fins 610 and facilitating movement of air that is ionized by an electric field created in a space between the corona electrode and the collector electrode.

The radiator 850 is provided with the air suction holes 810 and the air discharge holes 820. In the lighting apparatus having the above-described configuration, air is introduced through the air suction holes 810 and after being ionized, is discharged through the air discharge holes 820, enabling forcible cooling of the fins 610.

In the lighting apparatus according to the present embodiment, the plurality of fins 610 is arranged around an outer periphery of the radiator 850 so as to be cooled by movement of air facilitated by the radiator 850.

In FIG. 15, reference numeral 900 represents a separate housing or a socket for driving the light-emitting unit 300.

In addition, in the lighting apparatus according to the present embodiment, a width W2 of the region where the light-emitting unit 300 is present and a width W1 of an opposite lighting apparatus region may be freely determined according to desired external appearance, cooling capacity and the like.

Figure 16:
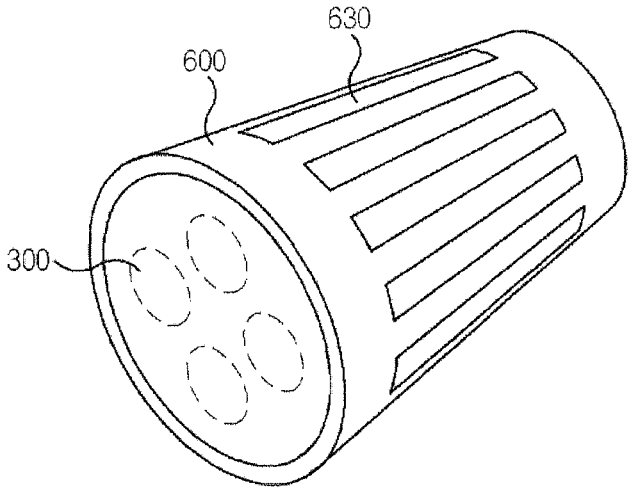
FIG. 16 is a schematic perspective view illustrating another example of a lighting apparatus according to the present invention.

FIG. 16 is a schematic perspective view illustrating another example of the lighting apparatus according to the present invention.

The lighting apparatus according to the present embodiment may include the radiator and the heat sink 600 serving as the housing of the lighting apparatus similar to the above-described lighting apparatus of FIG. 15, and the heat sink 600 may be provided with a plurality of openings 630 through which cool air outside the lighting apparatus is introduced and hot air inside the lighting apparatus is discharged to the outside.

Figure 17:
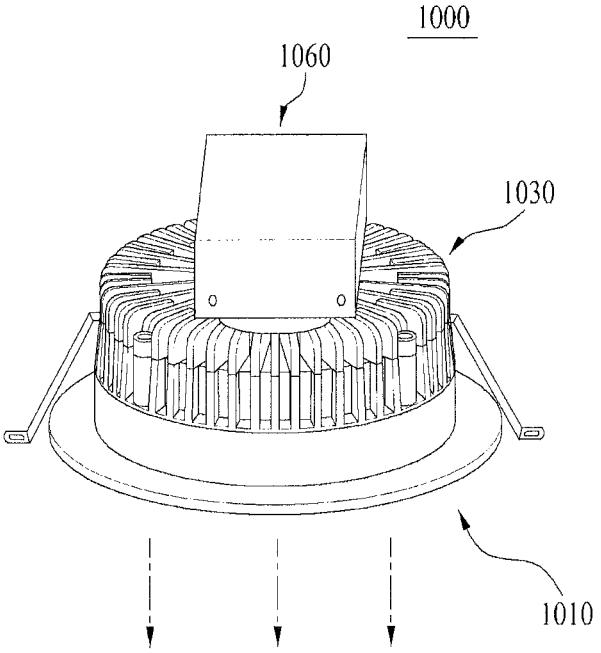
FIG. 17 is a perspective view illustrating a further example of a lighting apparatus according to the present invention.
Figure 18:
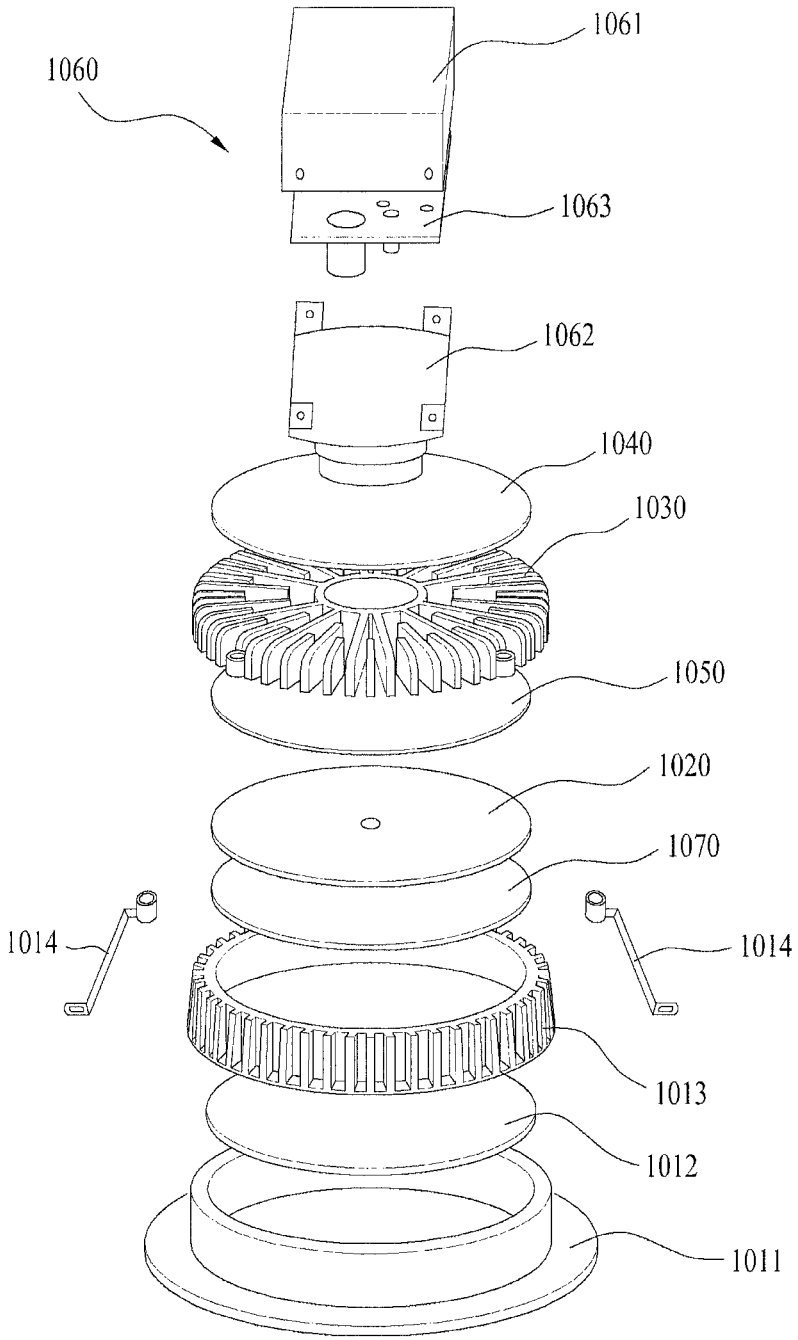
FIG. 18 is an exploded perspective view illustrating main components of the lighting apparatus illustrated in FIG. 17.

FIG. 17 is a perspective view illustrating a further example of the lighting apparatus according to the present invention, and FIG. 18 is an exploded perspective view illustrating main components of the lighting apparatus illustrated in FIG. 17.

The lighting apparatus 1000 according to the present embodiment may be installed in the ceiling or the wall of a home or office. According to the direction in which light is emitted, this may be referred to as downward-type lighting.

The lighting apparatus 1000 includes a housing 1010 having an air suction hole and an air discharge hole, a light-emitting unit 1020 placed in the housing 1010, a heat sink 1030 mounted to the light-emitting unit 1020 and serving to remove heat radiated from the light-emitting unit 1020, and a corona electrode 1040 and a collector electrode 1050 which cause movement of peripheral air of the heat sink 1030 via corona discharge.

The shape of the housing 1010 may be determined according to the shape of an installation space in which the lighting apparatus 1000 is embedded and the external appearance and configuration of the lighting apparatus 1000.

In an alternative embodiment, the housing 1010 may include a main body 1011 and a front case 1012 and a rear case 1013 mounted to the main body 1011.

The main body 1011 may have a circular ring shape having a central opening. Here, the above-described front case 1012 may be received in the opening. The front case 1012 may function as a light emitting surface.

The rear case 1013 embedded in the installation space may take the form of a grill through which air is introduced into or discharged from the housing 1010.

The housing 1010 may include at least one bracket 1014 to fasten the lighting apparatus 1000 to the wall or the like.

Referring to FIGS. 17 and 18, one longitudinal end of the bracket 1014 may be fixed to the rear case 1013, and the other longitudinal end of the bracket 1014 may be provided with a fastening hole for passage of a screw or the like.

The light-emitting unit 1020, the heat sink 1030, the corona electrode 1040 and the collector electrode 1050 are arranged in a space between the main body 1011 and the rear case 1013.

The light-emitting unit 1020, as described above, may include the substrate and the at least one LED mounted on the substrate. Here, the LED may be mounted on one surface of the substrate corresponding to the front case 1012.

In addition, the lighting apparatus 1000 according to the present embodiment may further include a reflecting sheet 1070 interposed between the light-emitting unit 1020 and the front case 1012.

The heat sink 1030 is placed in a space between the light-emitting unit 1020 and the rear case 1013. The heat sink 1030 may include a plurality of fins which come into contact with the other surface of the substrate opposite to the substrate surface on which the LED is mounted.

Referring to FIGS. 17 and 18, the heat sink 1030 may include a plurality of fins spaced apart from one another by a predetermined distance in a circumferential direction thereof.

The corona electrode 1040 and the collector electrode 1050 may be arranged with the heat sink 1030 interposed therebetween.

Although FIG. 18 illustrates the collector electrode 1050 as being located between the light-emitting unit 1020 and the heat sink 1030 and the corona electrode 1040 as being located above the heat sink 1030, the converse arrangements are also possible.

In addition, the above-described supporting member may be placed in a space between the heat sink 1030 and the collector electrode 1050 and/or in a space between the heat sink 1030 and the corona electrode 1040.

The supporting member may have various configurations and shapes suitable to serve as both a spacer and a flow path. In an alternative embodiment, the supporting member may include the plurality of supporting pieces (121 to 124 and 221 to 224, see FIG. 2) spaced apart from one another by predetermined distances in a peripheral direction of any one electrode.

The corona electrode 1040 and the collector electrode 1050 may have various configurations described with reference to FIGS. 1 to 15.

In an alternative embodiment, the corona electrode 1040 may be provided with a raised electrode region, and the collector electrode 1050 may be perforated with a through-hole, such that the raised electrode region of the corona electrode 1040 may be located inside the through-hole of the collector electrode 1050.

If voltage is applied to the respective electrodes 1040 and 1050, forced movement of ionized air occurs between the raised electrode region of the corona electrode 1040 and the collector electrode 1050.

The ionized air is forcibly circulated by convection between the fins of the heat sink 1030, acting to remove heat that is radiated from the light-emitting unit 1020 and is conducted to the respective fins of the heat sink 1030.

In addition, the lighting apparatus 1000 according to the present embodiment includes an electronic module 1060 to supply power to the light-emitting unit 1020 and the respective electrodes 1040 and 1050.

The electronic module 1060 may be mounted to the rear case 1030 so as to be embedded into the installation space.

The electronic module 1060 may serve to convert alternating current (AC) applied from an external source into direct current (DC) and supply the direct current to the light-emitting unit 1020 and the respective electrodes 1040 and 1050, and for example, may be a converter.

The electronic module 1060 may include cases 1061 and 1062, and a Printed Circuit Board (PCB) 1063 provided in a space defined by the cases 1061 and 1062.

As is apparent from the above description, in a lighting apparatus according to the embodiment of the present invention, a light-emitting unit can be cooled through movement of air ionized by corona discharge, rather than using a fan that tends to generate noise, resulting in reduced operational noise.

Further, in the lighting apparatus according to the embodiment of the present invention, the light-emitting unit can be cooled via movement of air that is induced through Electro-HydroDynamics (EHD), achieving enhanced cooling efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lighting apparatus comprising:

a housing having an air suction hole and an air discharge hole;

a light-emitting unit including a substrate placed in the housing and at least one Light Emitting Diode (LED) mounted on the substrate;

a heat sink mounted to the substrate of the light emitting unit, and a corona electrode and a collector electrode, which serve to discharge heat radiated from the light-emitting unit to the outside through the air discharge hole via corona discharge, wherein the heat sink includes a plurality of fins extending into a space between the corona electrode and the collector electrode.

2. The lighting apparatus according to claim 1, wherein:

the corona electrode includes a raised electrode region;

the collector electrode is provided with a through-hole; and the raised electrode region of the corona electrode is located inside the through-hole.

3. The lighting apparatus according to claim 2, wherein air ionized by corona discharge is directed from a space between the raised electrode region of the corona electrode and the collector electrode into the through-hole of the collector electrode.

4. The lighting apparatus according to claim 3, wherein the through-hole of the collector electrode has a smaller cross section than a cross section of the raised electrode region of the corona electrode.

5. The lighting apparatus according to claim 4, wherein a cross section of the corona electrode is smaller than a cross section of the collector electrode.

6. The lighting apparatus according to claim 2, wherein:

the substrate of the light-emitting unit is placed above the collector electrode, and the corona electrode is placed below the collector electrode; and a first air channel is defined between the corona electrode and the collector electrode, and a second air channel is defined between the collector electrode and the light-emitting unit.

7. The lighting apparatus according to claim 6, wherein the light-emitting unit is spaced apart from the collector electrode by a predetermined distance.

8. The lighting apparatus according to claim 6, wherein a supporting member is provided in at least one of the space between the corona electrode and the collector electrode or a space between the collector electrode and the light-emitting unit so as to maintain a predetermined distance between the corona electrode and the collector electrode and/or between the collector electrode and the light-emitting unit.

9. The lighting apparatus according to claim 8, wherein the supporting member is provided with a flow path to allow any one of the spaces to be communicated with the air suction hole or the air discharge hole of the housing.

10. The lighting apparatus according to claim 9, wherein:

the supporting member includes a plurality of supporting pieces spaced apart from one another by a predetermined distance in a peripheral direction of any one of the electrodes; and a space between the two neighboring supporting pieces functions as the flow path.

11. The lighting apparatus according to claim 1, further comprising a receiving member fixed in the housing such that the corona electrode is seated in the receiving member.

12. The lighting apparatus according to claim 10, wherein the receiving member is provided with a through-hole for insertion of the collector electrode.

13. The lighting apparatus according to claim 1, further comprising:

a controller which generates a control signal required to apply voltage to the corona electrode and the collector electrode; and a voltage supply unit to apply voltage to the corona electrode and the collector electrode in response to the control signal.

14. A lighting apparatus comprising:

a housing having an air suction hole and an air discharge hole;

a light-emitting unit including a substrate placed in the housing and at least one Light Emitting Diode (LED) mounted on the substrate;

a heat sink mounted to the substrate and serving to dissipate heat radiated from the LED;

a collector electrode placed below the heat sink; and a corona electrode spaced below the collector electrode by a predetermined distance, wherein:

the corona electrode is provided with a raised electrode region, the collector electrode is provided with a through-hole, and the raised electrode region of the corona electrode is located inside the through-hole.

15. The lighting apparatus according to claim 14, wherein:

the heat sink includes a plurality of fins made of an insulating material and arranged to come into contact with the collector electrode; and air ionized by corona discharge is directed from a space between the raised electrode region of the corona electrode and the collector electrode into the through-hole of the collector electrode and is discharged to the outside through a space between the two neighboring fins.

16. The lighting apparatus according to claim 15, wherein the through-hole of the collector electrode has a smaller cross section than a cross section of the raised electrode region of the corona electrode.

* * * * *